US006601270B2

(12) United States Patent
Eckhardt et al.

(10) Patent No.: US 6,601,270 B2
(45) Date of Patent: Aug. 5, 2003

(54) FITTING FOR A WINDOW OR DOOR

(75) Inventors: Martin Eckhardt, Marburg (DE); Reinhold Reitz, Willingshausen (DE); Helmut Alber, Schlanders (IT); Frank Debus, Bauschenberg (DE); Bernhard Schaub, Stadtallendorf (DE)

(73) Assignee: Hoppe AG, Stadtallendorf (DE)

( * ) Notice: Subject to any disclaimer, the term of this patent is extended or adjusted under 35 U.S.C. 154(b) by 0 days.

(21) Appl. No.: 09/834,949

(22) Filed: Apr. 16, 2001

(65) Prior Publication Data

US 2001/0052202 A1 Dec. 20, 2001

Related U.S. Application Data

(63) Continuation of application No. PCT/EP99/07736, filed on Oct. 14, 1999.

(30) Foreign Application Priority Data

Oct. 17, 1998 (DE) ..... 29818559 U
Mar. 5, 1999 (DE) ..... 29903896 U

(51) Int. Cl.[7] ..... E05B 65/08
(52) U.S. Cl. ..... 16/412; 70/89; 70/90
(58) Field of Search ..... 16/412, 414, 433, 16/441; 292/336.5, 347, 358, DIG. 61, DIG. 62, DIG. 52; 70/91, 102, 89, 90

(56) References Cited

U.S. PATENT DOCUMENTS 4,036,039 A * 7/1977 Nakanishi ..... 292/111
4,876,866 A * 10/1989 Fleming et al. ..... 292/336.5
5,029,914 A * 7/1991 Hankel ..... 292/336.3
5,177,987 A * 1/1993 Shen ..... 292/336.3
5,364,139 A * 11/1994 Bergen et al. ..... 292/169
5,605,064 A * 2/1997 Katayama et al. ..... 292/336.3
5,657,653 A * 8/1997 Hensley et al. ..... 292/DIG. 62

* cited by examiner

*Primary Examiner*—Anthony Knight
*Assistant Examiner*—Doug Hutton
(74) *Attorney, Agent, or Firm*—Clark & Brody

(57) ABSTRACT

A handle (10) supported pivotably but axially tight on an installation body (20) has a polygonal bar (30) mounted for rotation within a handle neck (12) for actuating a closing mechanism. Two drivers (15, 35) movable relative to each other are engageable in a non-positive and/or a positive way between neighboring surfaces (17, 37) either directly or by means of coupling elements (36, 40, 42) so that a torque transmission from the handle (10) to the polygonal bar (30) is free but is blocked from the polygonal bar (30) to the handle (10) as at least one coupling element (36) is displaced in the direction of the attack. A main portion of a polygonal driver (35) may be concentrically enclosed by a two-shell handle driver (15) having wings (52) with front faces (19) which drive e.g. pairs of spring-loaded roller pins (36) held in a wedge-shaped confining zone (55). Corner areas of indentations (31) of the polygonal driver (35) serve to attack the roller pins (36). Central parts (50) of the handle driver (15) may guide a compression spring (38) which loads engaging balls (47) in an outward direction; recesses (27) of the installation body (20) are associated to the balls (47) at enclosing surfaces (24; 44).

23 Claims, 9 Drawing Sheets

FITTING FOR A WINDOW OR DOOR

This application is a continuation of international application number PCT/EP99/07736, filed Oct. 14, 1999.

The corresponding PCT application was not published in English.

Fittings such as handle means for opening and closing room confining elements, i.e. windows and doors, are often designed as turning means fastened to a window frame or door leaf by fastening devices, such as roses, base plates or the like, for actuation of a corresponding closing mechanism via a driver pin, e.g. a square bar, incorporated in the handle means.

In order to avoid operation by unauthorized persons, various safety devices have been developed, among them snap-button catches and so-called child locks. DE 295 18 723 U1, for example, describes a fitting provided with a slide arranged on the outside of a handle. Said slide has to be moved aside in order that an axial force can be applied to the spring-loaded handle neck which may thus be coupled with a stop sleeve guiding the square bar; the handle can only be turned after engaging therewith.

With other designs the handles may be locked in selected positions, e.g in 90-degree positions. In order to release a handle locked in this way, a corresponding element has to be operated first. But if a handle is not already in a preset angular position, locking is not possible and the handle can be moved even by action from outside, too. Burglary methods are based on this fact.

With turning/tilting fittings provided with a transmission serving for converting a rotary movement into a linear movement of a connecting rod, the locking mechanism can be disabled by drilling a hole through the window frame from outside and shifting the rod using a tool passed through the hole. A window can also be opened if a hole is drilled into the frame from outside at the height of the square bar which can then be attacked by a tool. In either case the square bar can be rotated, and as a result the fitting can be unlocked.

It has been tried to avoid this risk by means of the widely used lockable window handles which cannot be moved when locked. In this case the user has to make sure that the handle is always locked. For this purpose, a key is required in general, which must not be easily accessible to third persons; but the aggravated access to the key impairs the use by authorized persons so that they are often too lazy to lock the window.

Other common disadvantages of the known devices consist moreover in the fact that the design of window handles is somewhat restricted if they are to be provided with safety devices, e.g. of the aforementioned type. Users are also obliged to acutally operate the corresponding elements and at that partly in a direction which is different from the usual mode of operation.

It is an important aim of the invention to overcome these and other disadvantages of the state of the art and to create improved handle means which offer considerable resistance to attacks from outside but which can be easily operated inside the room. In addition to a clear cut structure, cheap production and mounting are aimed at. Another object is to economically achieve greater independence regarding design, use and/or sequences of motions.

This task is solved by a window and/or door fitting for actuating a closing mechanism, comprising handle means including at least one handle whose handle neck is axially but pivotably supported on or in an installation body, which body is adapted to be fastened to a flat support, in particular a room closing element such as a door leaf, window frame or the like, and comprising a polygonal bar engaging into or penetrating the installation body, the polygonal bar being connected for rotation with the handle for actuating of the closing mechanism, wherein according to the claims of the invention a coupling assembly is provided between the handle and the polygonal bar such that a torque transmission is achievable from the handle to the polygonal bar but is blocked from the polygonal bar to the handle. This results in a rotatable handle in the way of a mechanical diode which, depending on the direction of operation, either permits or prevents the usual movement of the handle. Thus safety will be considerably increased in a very simple way. The overall time and costs involved for the structure are small so that the assembly consisting of but few components can be easily manufactured and mounted.

Another embodiment of the invention is based on a fitting by way of a handle, comprising a handle driver which is designed as a slide and is guided linearly within an enclosure, e.g. a housing, an installation body or a groove of a flat support—in particular a room closing element such as a door leaf, a window frame or the like—, further comprising a driven engaging member that is displaceable within limits in relative to the handle driver, which member includes a driven element arranged at a right angle to the casing or installation body and connected with the handle for actuation of a closing mechanism, and further comprising a coupling assembly arranged between the handle driver and the driven element, which assembly has a coupling element located between push or front faces of the handle driver and by means of which a handle movement may be released or blocked, depending on whether a force is applied to the handle or to the driven element. In accordance with the invention, the claims provide that the coupling element is designed as a drop-in pin which, depending on the position of the handle driver, either slidably engages the enclosure [release position] or enters into a locking depression [blocking position]. It will be seen that this type of construction is not restricted to a rotary operation, but uses generally displaceable and especially linearly movable elements which are functionally connected via a sturdy coupling element that also acts as a locking element.

Although a similar principle has been known from DE 35 20 861 A1, that publication relates to a non-reversing device for espagnolette-type fittings which can be actuated from a lock via a connecting-rod drive. In this design, a leaf spring invariably attached to a connecting-rod section is either moved into a locking position or disengaged from it, and blocking is exclusively based on engagement of one end of the spring on a narrow locking shoulder which may wear out and/or—under a strong momentum on a latch/bolt—may be overcome by buckling the basically weak leaf spring. By contrast, the novel coupling assembly includes a drop-in bolt which is movably confined between two drivers but is not rigidly attached to either driver and which, moreover, forms with its body itself a locking element that is laterally displaceable in a gliding/rolling movement and acts through wedge-like self-locking. Even great forces applied to the driven side cannot overcome this blockage due to the massiveness of the drop-in bolt.

Further features, details and advantages of the invention will follow from the wording of the claims as well as from the following description of embodiments shown in the drawings wherein:

Figure 5B:
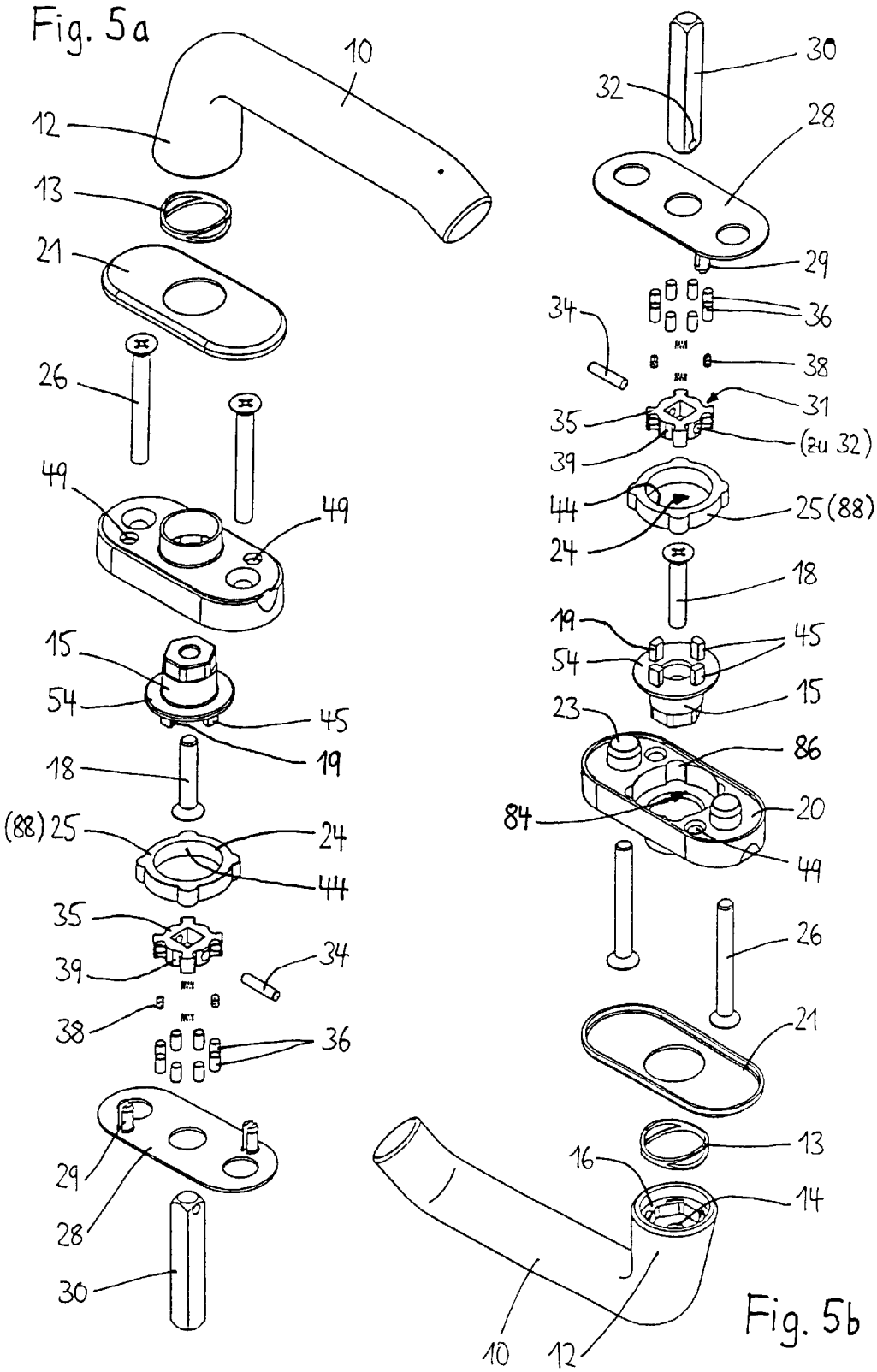
Figure 6C:
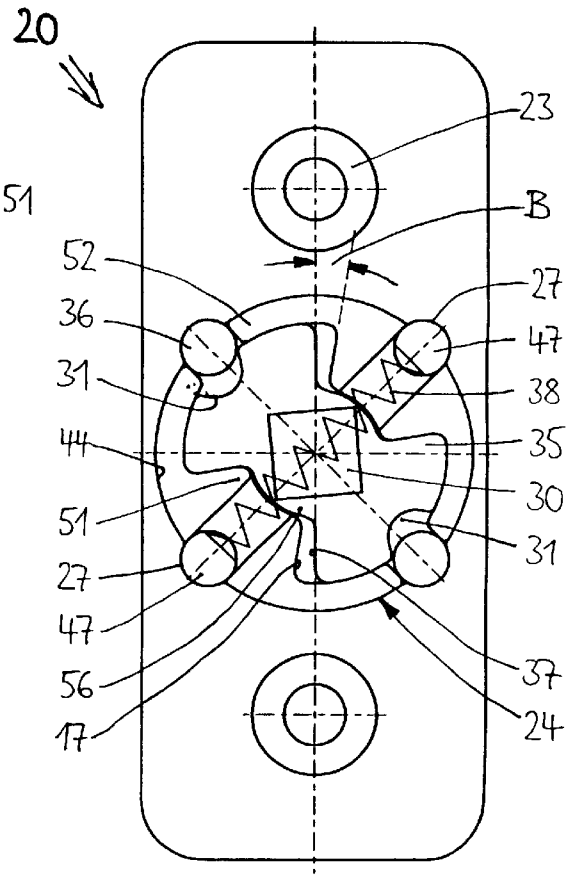
Figure 6B:
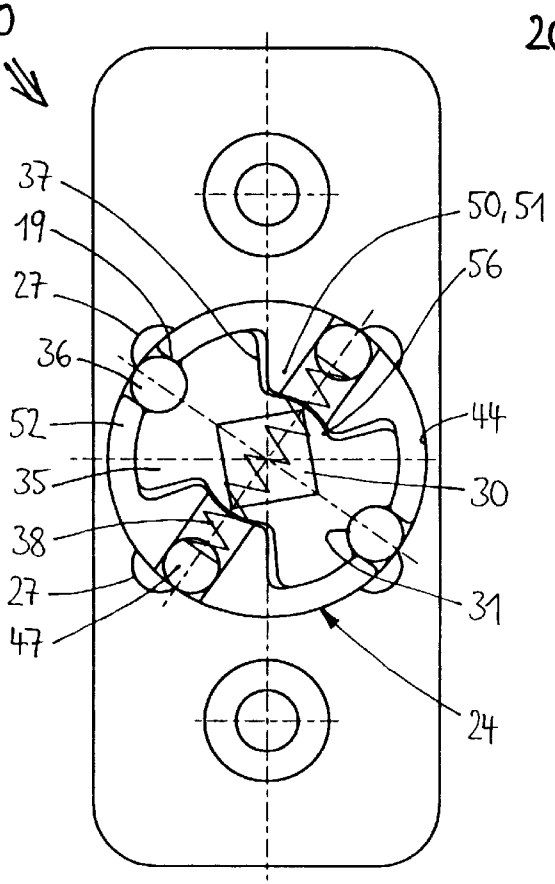
Figure 6A:
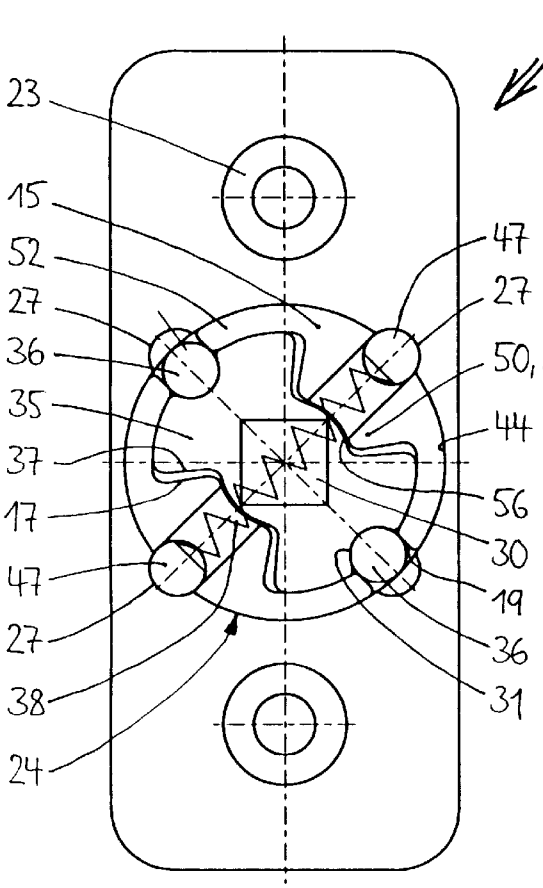
Figure 7C:
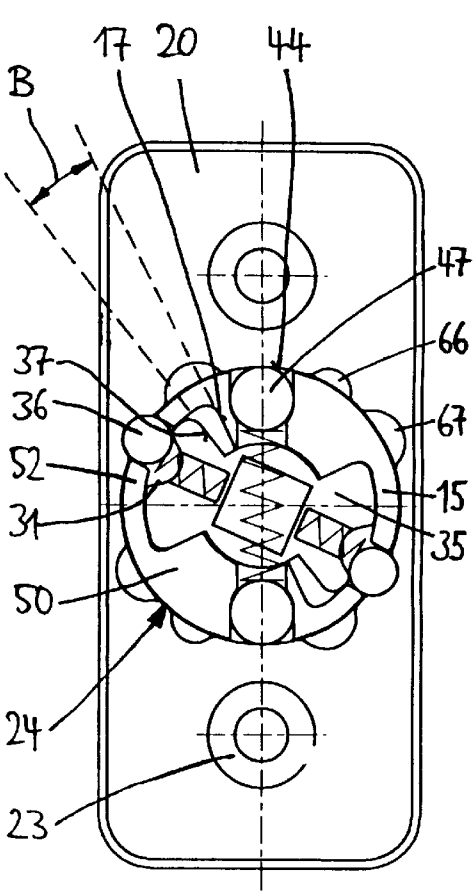
Figure 7B:
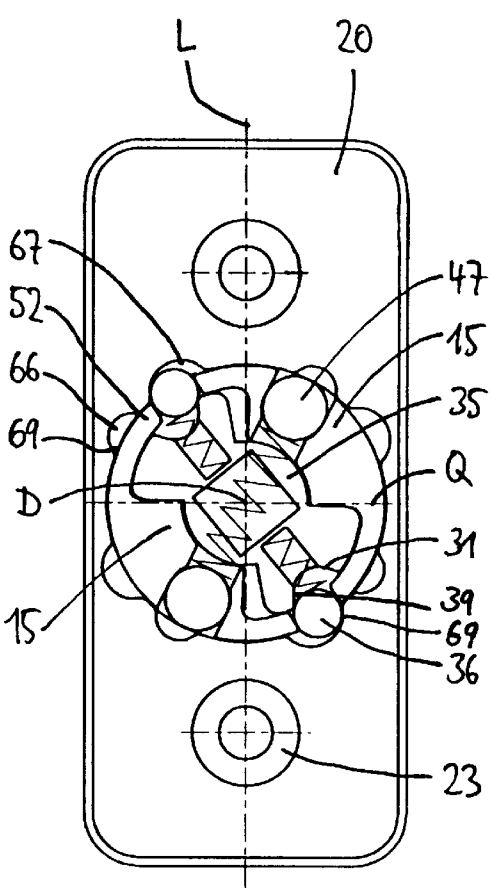
Figure 7A:
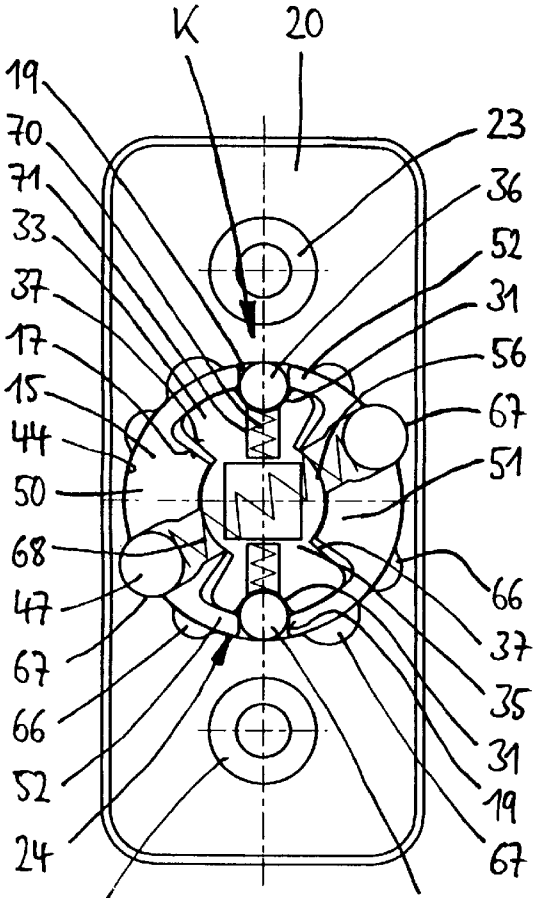
Figure 8:
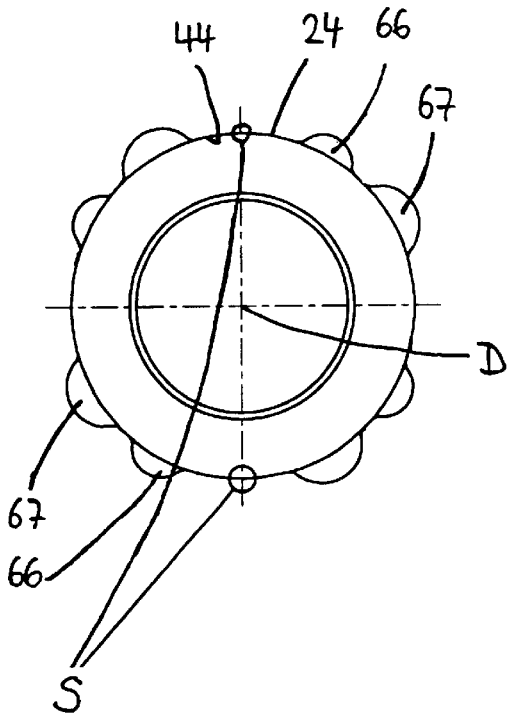
Figure 9:
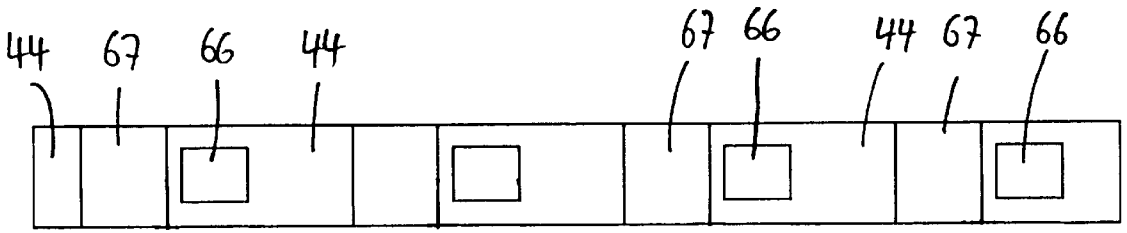
Figure 10A:
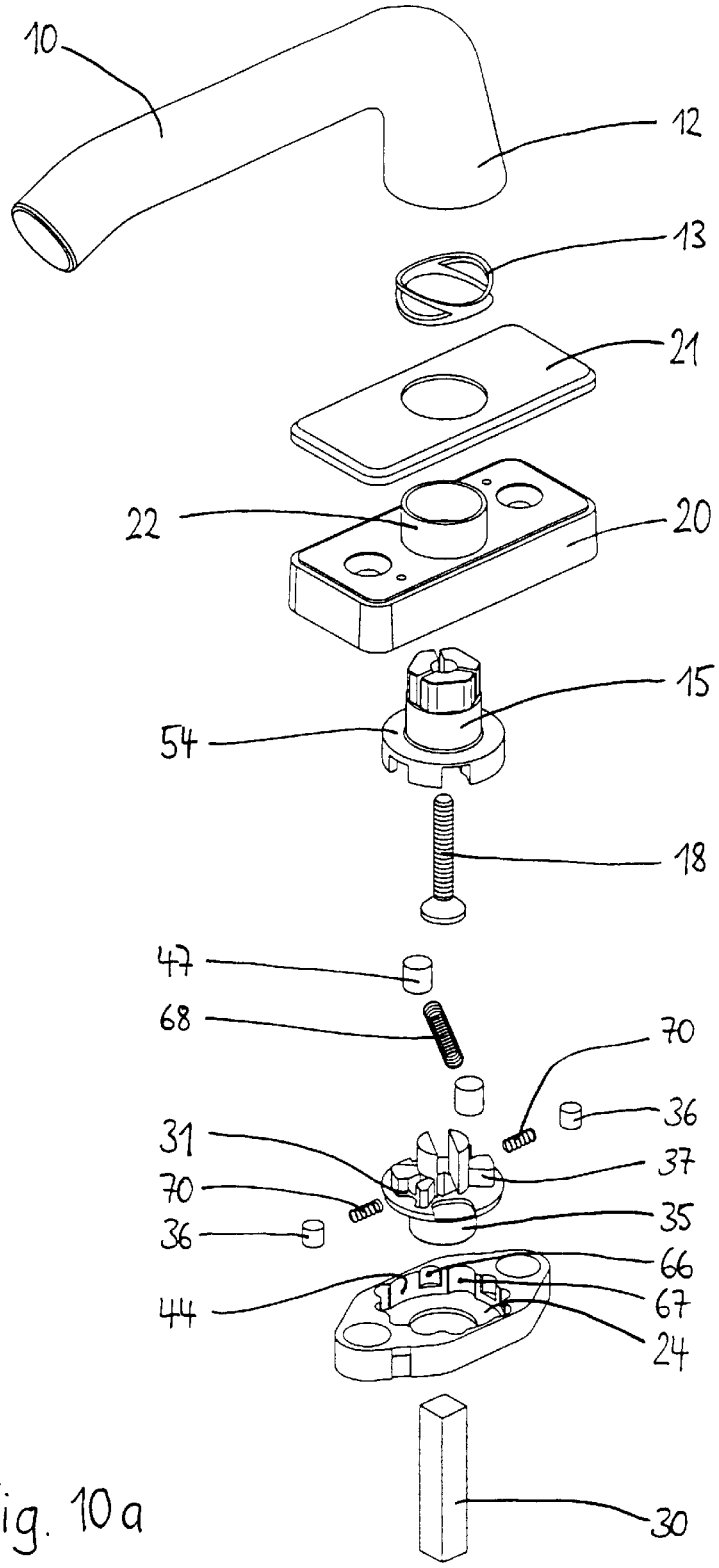
Figure 10B:
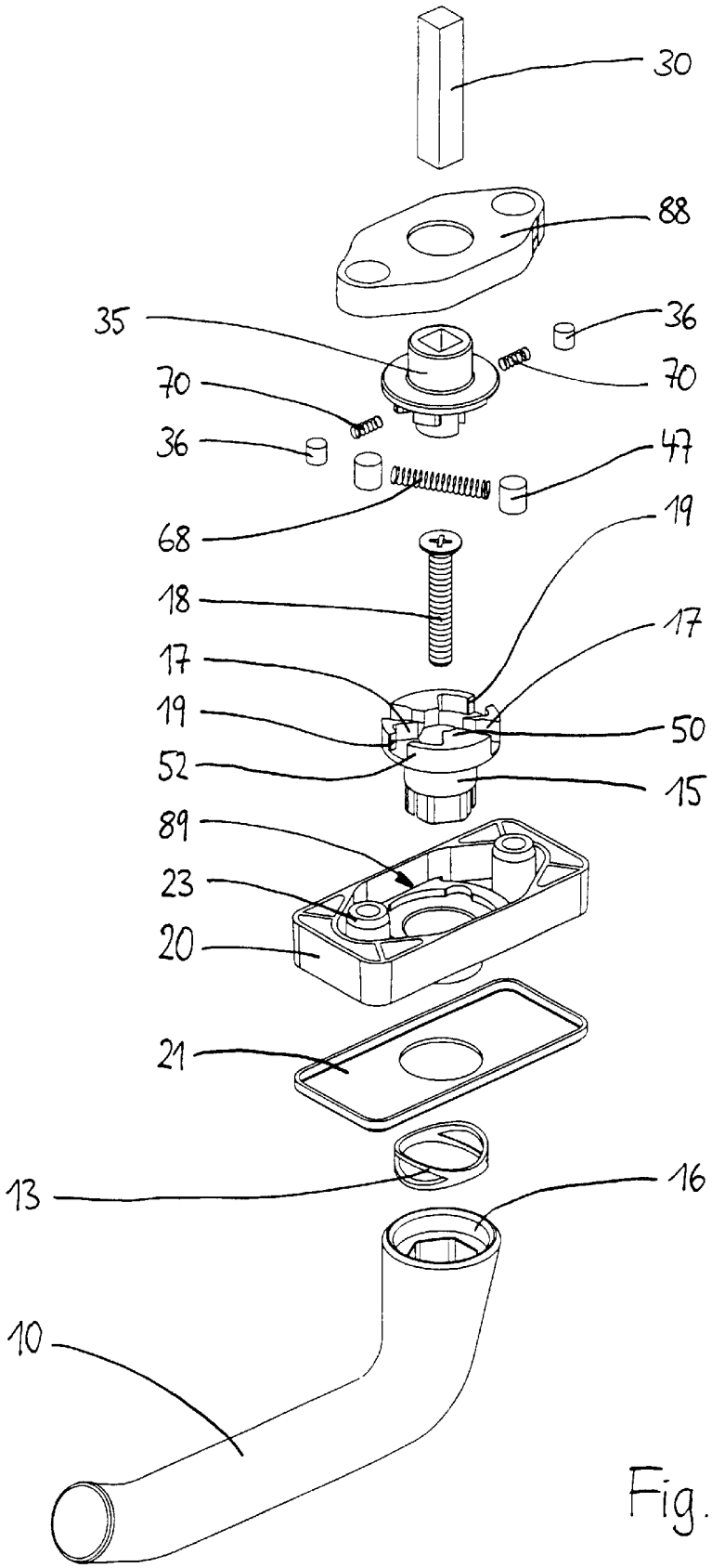

FIGS. 5*a*, 5*b* show each an exploded oblique view of the components of a window handle as seen in FIG. 5 in top and bottom views, respectively, FIGS. 6*a* to 6*c* show each a bottom view of another embodiment, viz. in a rest position as well as in two different working positions, FIGS. 7*a* to 7*c* show each a bottom view of a different embodiment of a fitting in a rest position as well as in two different working positions, FIG. 8 is a separate representation of a fitting recess in an installation body, FIG. 9 shows a developed view of the inner circumference of the fitting recess of FIG. 8, FIGS. 10*a* to 10*b* show each an exploded oblique view of the components of the window handle in FIGS. 7*a* to 7*c* and FIGS. 11*a* to 11*c* show each a schematized side view of a sliding mechanism for handle means.

Figure 1:
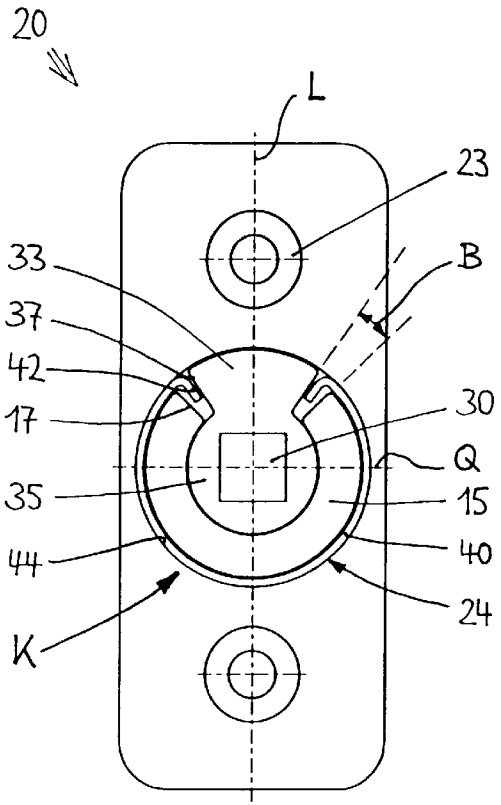
FIG. 1 is a bottom view of an installation body of a fitting.

FIG. 1 shows the bottom of an installation body 20 designed to be attached to a window or door surface (not shown) by means of bored lugs 23. A square bar 30 is centrally seated which may be rotated around the same axis as a handle (not shown here) that is connected for rotation with a handle driver 15. Also connected for rotation with the square bar 30 is a square member 35 whose main portion is concentrically enclosed by the handle driver 15. The handle driver 15 and the square member 35 are driver components of a coupling assembly (K) for torque transmission which is free from the handle to the polygonal bar 30 but is blocked from the polygonal bar 30 to the handle.

A projection 33 of the square member 35 extends up to an inner wall 44 of a cylindrical fitting recess 24 in the bottom of the installation body 20 The main portion of a leaf spring 40 rests against the inner wall 44, enclosing the handle driver 15. At a predefined small distance from the ends of the handle driver, which form contact surfaces 17, the spring 40 is provided with angular ends 42 adapted to the shape of the projection 33 of the square member 35 and located between the contact surface 17 of the handle driver 15 and a contact surface 37 of the square member 35 in the rest position shown.

As the handle including the handle driver 15 is turned, a contact surface 17 will meet a spring end 42 that will be pulled along a little bit so that the spring diameter is reduced. Now the spring 40 which fit accurately before can easily move along the inner wall 44. As the handle driver 15 is turned further, said spring end 42 will be pushed onto the contact surface 37 of the square member 35 whereby the rotation will be transmitted to the square bar 30 via the projection 33 and the member 35. Thus the leaf spring 40 serves as a coupling element, i.e. it couples the handle driver 15 and the square member 35 in such a way that a torque acting on the handle will be transmitted to the square bar 30 as long as the contact surface 17 pushes the respective spring end 42 and thus the square member 35. The handle can be freely turned.

However, if a torque acts primarily on the square bar 30, a contact surface 37 of the driver projection 33 will rest against the corresponding angular end 42 of the plate 40. As a result, the diameter of the spring will be increased even with but minimum upsetting of the corresponding spring end 42 Consequently the spring 40 will jam against the inner wall 44 with the result that handle rotation is suppressed immediately and completely.

It will be seen that the handle driver 15, the spring 40 and the square member 35 are designed and arranged symmetrically to the longitudinal center L of the installation body 20 so that functional independence of the sense of rotation will be ensured. Another important feature is a predefined rotation angle clearance B between the two drivers 15 and 35 as determined by the distances between the contact surfaces 17 and 37, which spacing must be greater than the thickness of the spring element 42 located between them. Owing to this dimensioning, a driver may be rotated (within rotation angle clearance B) without the rotation being transmitted to the other driver, but with a force acting on the spring 40. Since the spring serves as a coupling element, it will be jammed under frictional engagement—starting from the rest position shown—in one direction and will be released in the opposite direction.

Figure 2:
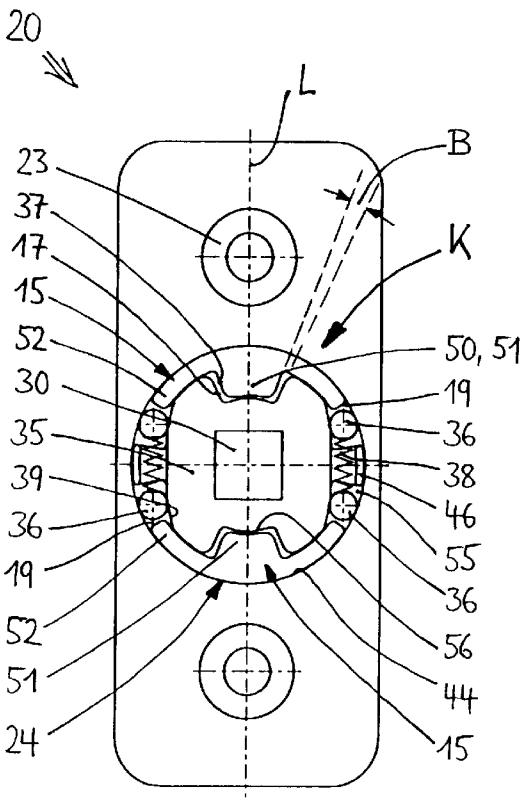
FIG. 2 is comparable bottom view of another embodiment.

Another embodiment of a self-locking mechanism for a turning handle is seen in FIG. 2. Again the two drivers 15 and 35 of the coupling assembly K are pivoted on the axis arranged concentrically to the square bar 30. Between them in a circumferential direction, there are pairs of coupling elements 36 designed, for example, as roller pins, each pair being pressed apart by a compression spring 38. The handle driver 15 consisting of two shells has on each shell a central part 50 with curved wings 52 whose peripheral ends have or form push or front faces 19, respectively. Moreover the drivers 15, 35 comprise engaging elements shaped as a projection 51 and a matching concavity 56 and arranged relative to each other with a rotation angle clearance B in such manner that the contact surfaces 17 and 37, respectively, are separated in the rest position shown. The springs 38 between the roller pins 36 or cylinder rolls are guided along webs 46 that extend along the inner wall 44 of the fitting recess 24. The webs 46 are arranged symmetrically between the front faces 19 of the curved wings 52 of the handle driver 15 and prevent the springs 38 from outside rubbing, i.e. on the fitting recess 24 or the inner wall 44, during the rotations; this will contribute to the easy motion of the window handle.

As shown in FIG. 2, the shapes of the drivers 15, 35 will permit the reciprocal transmission of rotations without coupling elements between them. However, in interaction with wedge surfaces 39 on the square member 35, the rotation angle clearance B existing between the surfaces 17, 37 will determine the function explained below.

The coupling elements 36 are located in an intermediate space 55 of approximately trapezoidal basic shape, which space is defined by the cylindrical inner wall 44, by the push or front faces 19 as well as by the wedge surface 39. The space 55 widens toward the spring 38, and under its spring force each of the two roller pins 36 of each pair will continuously be pressed into this wedge-shaped intermediate space 55 as far as possible.

As the handle and thus the handle driver 15 is moved, this can first be done without transmitting a rotation to the square member 35 until the distance between the contact surfaces 17, 37 has been bridged. Rather, the front face 19 of the curved wing 52 will press against the force of spring 38 on the adjacent roller pin 36 and push it out of the wedge-shaped intermediate space 55 tangentially to the annular surface 44. The coupling element 36 is freely movable in the widening zone 55. Immediately afterwards, the contact surfaces 17 and 37 of the two drivers 15 and 35, respectively, which may be rotated relative to each other, will meet whereby further rotation of the outer driver 15 will be completely transmitted to the inner driving member 35. Owing to the friction caused on the inner wall 44 by the rotation, the roller pin 36 at the opposite end of the spring 38 will also be pushed out of the corresponding wedge-shaped intermediate space 55 whereby both coupling elements 36 are freely movable. Turning of the window handle will transmit itself to the square pin 30 without hindrance.

If, however, a torque attacks the inner driving member 35 first and exclusively, the latter's wedge surface 39 will act on the corresponding roller pin 36. Because of the geometrical conditions, the force acting on the pin has a very small tangential component and a big radial one. Therefore, the roller pin 36 will be pressed perpendicular against the inner wall 44 with great force with the result that rotation will be prevented by the strong friction generated It will be seen that any direct or indirect rotation of the square pin 30 will cause jamming of each coupling element 36, after the rotation angle clearance B has been bridged, whereby any further rotation is blocked immediately.

It may be advantageous to provide the enclosure 24/44 with a material that is more resilient than the materials of the square member 35 and of the coupling elements 36. As a result, the driven roller pin 36 can press into the inner wall 44 as the inner member 35 is turned, thus causing a positive locking which permits an increased torque load on the square member 35.

Figure 3:
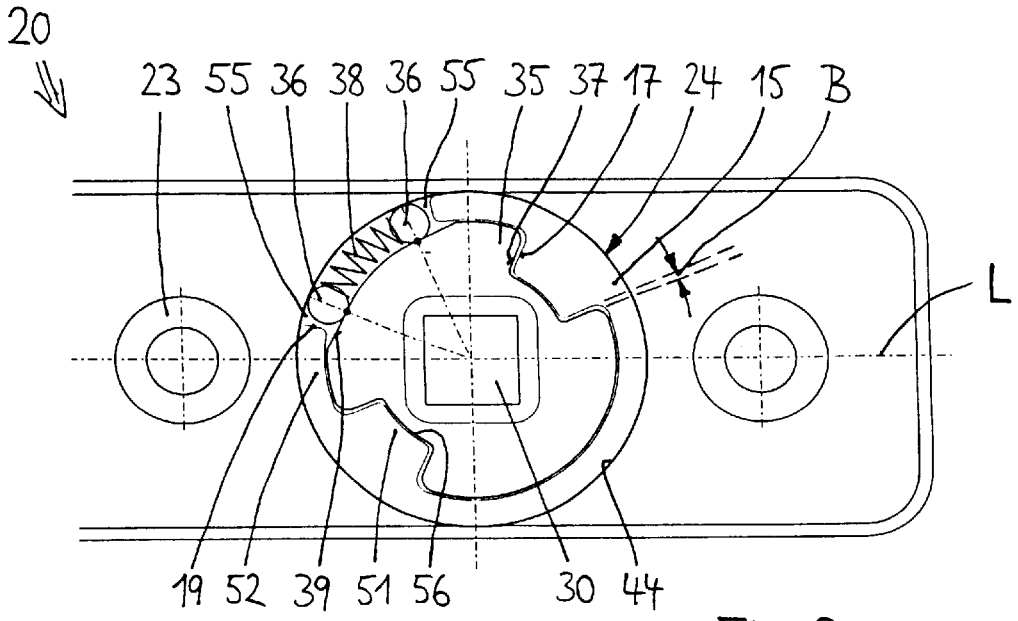
FIG. 3 is a bottom view of still another embodiment.

FIG. 3 shows another embodiment that is similar to FIG. 2 but of a simplified structure. Here, only one laterally arranged pair of roller pins 36 is loaded by the compression spring 38. It will permanently remain in the wider zone of a wedge-shaped intermediate space 55 formed between the inner wall 44 and the opposite boundary of the square member 35 with its wedge surfaces 39 as the handle driver 15 is rotated. Whereas the handle can thus be moved without hindrance, any attacking force applied to the square bar 30 will cause blocking due to the polygonal square member 35 being taken along once the rotation angle clearance has been bridged. A material-determining permanent deformation of the inner wall 44 by torque action from the attack side of a door or window will be noticed by the user as a malfunction of the handle. This is also an indication that the handle 10 or at least its internal mechanism has to be replaced and/or that another safety measure should be taken.

Figure 4:
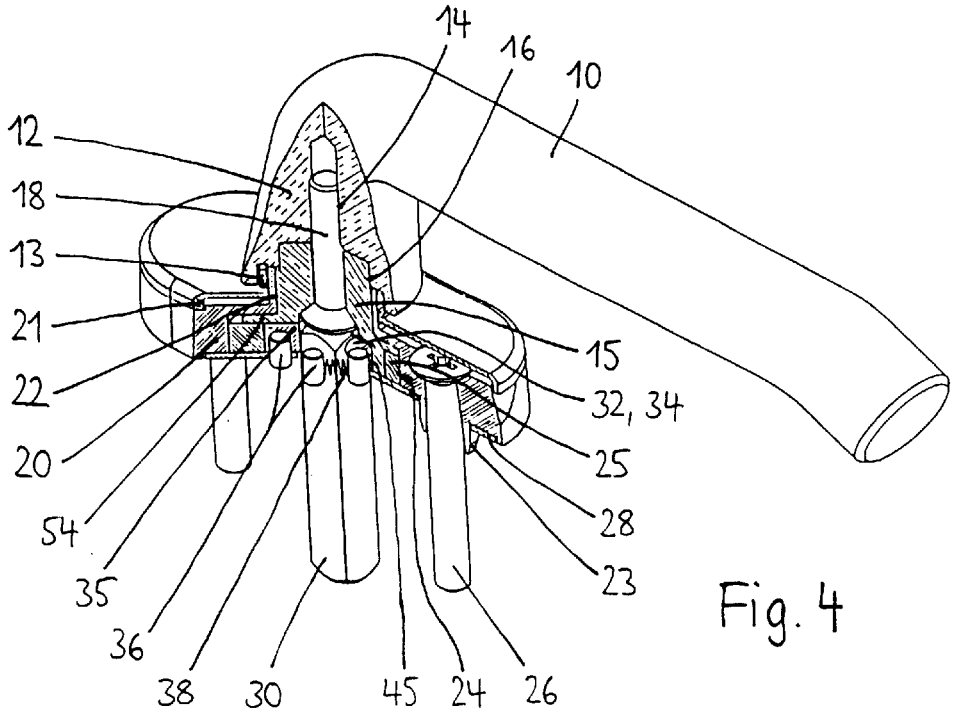
FIG. 4 is an oblique view, partly sectional, of a turning handle means.

The oblique view of FIG. 4 shows in partial section a handle 10 having a handle neck 12 and a recess 16 which axially continues as a threaded hole 14. An installation or mounting body 20 has a guide sleeve 22 as well as bored lugs 23 for receiving fastening screws 26 (whose thread is not shown for simplicity). The installation body 20 is topped by a cover plate or cap 21 which liftably bears against the bottom of the handle neck under the upward force of a compression spring 13. At its bottom, the installation body 20 has a recess 84 that is concentric with the guide sleeve 22 and is provided with indentations 86, for positively seating an insert 88 formed as a locking ring 25 (FIG. 5*b*). This ring includes a fitting recess 24 wherein the polygonal member 35 pivots, which is connected for rotation with a polygonal spindle (here: square bar) 30. For this purpose, said polygonal bar comprises a transverse hole 32 for receiving a locking pin 34 which penetrates the polygonal member 35 in or on whose periphery there are roller pins or cylinder rolls 36 arranged in pairs. Preferably, there are four pairs with a compression spring 38 being provided between two roller pins each.

The handle driver 15 has a head piece which is slidably pivoted in the guide sleeve 22 and whose end is adapted to the shape of recess 16 in the handle neck 12. A countersunk screw 18 fastens the handle driver 15 in the handle 10 by engaging the threaded hole 14 in handle neck 12 so that the top of an annular flange 54 formed on the handle driver 15 (FIG. 5*b*) will glide inside the installation body 20. On its back the annular flange 54 is provided with projections 45 which surround the polygonal member 35 concentrically. The peripheral ends of the projections 45 associated with the roller pins 36 form the front faces for push or front faces 19.

It will be seen that the square member 35 in the example shown has four spoke-like arms peripherally rounded for sliding fit in the locking ring 25. These arms are bordered by curvatures 56 (see FIG. 3) with wedge-shaped surfaces 39 which, together with the pairs of spring loaded roller pins 36, will cause a self-locking action as described above as soon as a predefined rotation angle clearance B between the square member 35 and the handle driver 15 has been bridged.

FIG. 5*a* shows the components of such a handle means in an exploded oblique view from above whereas FIG. 5*b* shows corresponding oblique views from below. It will be seen that after mounting of the individual parts, the installation body 20 is covered by a bottom plate 28 having stay bolts 29 that engage associated bores 49 of the body 20. The function of the assembly of FIGS. 4, 5*a* and 5*b*, respectively, corresponds largely to that of FIGS. 2 and 3 in which, however, self-locking may be achieved by frictional engagement inrrespective of any preferred handle positions.

Still another embodiment of a self-locking fitting is shown in the bottom views of FIGS. 6*a* to 6*c*. Again a handle driver 15 encloses a square member 35 concentrically within a cylindrical fitting recess 24, but without lateral contact surfaces 17, 37 of the drivers 15, 35 contacting each other in a rest position (FIG. 6*a*). The two-shell handle driver 15 connected with the handle—not shown here—has central parts 50 each provided with a projection 51 toward the square bar 30 which is axially recessed in the inner drive 35 that has a recess 56 shaped to match the projections 51. The central parts 50 are bordered by curved wings 51 whose ends have or form push or front faces 19. Between these faces individual roller pins or cylinder rolls 36 are provided, to which counter-shaped indentations 31 in the square member 35 are associated in an inward radial direction. The central parts 50 of the two halves of the handle driver 15 guide a compression spring 38 as well as engaging balls 47 having the same outer diameter as the roller pins 36. By spring 38, said balls are pressed against the inner wall 44 of the fitting recess 24, where engaging depressions 27 are provided at equidistances, preferable staggered by 90 degrees.

FIG. 6*b* shows a condition in which the assembly is turned to the left in relation to the position described above by moving the handle and consequently the handle driver 15. During this operation, the engaging balls 47 move inward and contact the inner wall 44, due to the attack of corner zones of the recesses 27, whereas the roller pins or coupling elements 36 are moved on a circular path along the inner wall 44 in contact with the front faces 19 of handle driver 15. In case the coupling elements 36 have been located in the recesses 27 beforehand, the orientation of the push faces 19 and the corner shape of the recesses 27 will ensure that the handle driver 15 disengages the roller pins 36 therefrom. They will enter into the indentations 31 of the square member 35 so as to be positively coupled with and taken along by the handle driver 15. The balls 47 pressed inward will roll along the inner wall 44.

If one tries to turn the square bar 30 (FIG. 6*c*) starting from the rest position shown in FIG. 6*a*, a corner zone of the indentation 31 of the square member 35 will move the roller pins 36 radially outward. They will thus move into the recesses 27 of the installation body 20 and immediately block any further movement of the square member 35. It will be seen that the square bar 30 may only by rotated through a small angle defined by the rotation angle clearance B before the self-locking action suppresses any further rotation. An important feature of this design is that it is secured against operation from outside irrespective of any specific locking position.

In order that a torque transmission from the polygonal bar 30 to the handle 10 may also be blocked outside specific locking positions of the handle 10, the embodiment according to FIGS. 7*a* to 7*b* provides a fitting recess 24 having four locking depressions 66 and four engaging depressions 67 which—as shown in detail in FIG. 8—are located in radial symmetry to the axis of rotation D of the handle 10 and of the drivers 15, 35 and are preferably arranged at angles of 30 and 60 degrees relative to a longitudinal axis L and to a lateral axis Q, respectively, of an installation body 20. Coupling elements 36 provided between the handle driver 15 and the polygonal driver 35 are designed as locking pins. Engagement for finding the specific locking positions of the window fitting is realized by means of a compression spring 88 and of drop-in pins 47 which under spring tension are pressed to the inside 44 of the fitting recess 24 or into engaging depressions 67 of the matching shapes. Turning the handle away from a respective engaged position will cause the drop-in pins 47 to be pushed out of the depressions 67 against the tension of the compression spring 68, thus increasing the torque for the user. The length of the drop-in pins is selected such that they can only be pressed into the engaging depressions 67 and not into the locking depressions 66. For this purpose and as shown in FIGS. 8 and 9 the engaging depressions 67 have a greater diameter as well as a greater length than the locking depressions. The same applies to the locking and drop-in pins 36, 47, respectively, whereby it is ensured that an increased torque is felt by the user only in the specific locking positions of the handle or fitting, in this case every 90 degrees. By contrast, the size of the locking pins 36 permits them to be pushed into the engaging depressions 66 as well as into the locking depressions 67.

FIG. 7*a* shows the assembly in a specific locking position of the handle as the engaging pins 47 have been pressed into the engaging depressions 67 by spring tension. The polygonal member 35 in its turn has two indentations 31 each receiving a locking pin 36. Said pins are located with a minimum clearance of motion between two push faces 19 of the two-shell handle driver 15 at the starting points S indicated schematically in FIG. 8 so that the indentation 31 of the polygonal driver 35 and the front faces 19 of the handle driver 15 will positively engage as the handle driver 15 is turned. This subdues any clearance of the rotation angle between the two drivers 15, 35, except for rotation angle clearance caused by the manufacturing tolerances of the components.

A compression spring 70 is fixed in a blind hole 71 of the polygonal member 35 for each locking pin 36, the tension of said spring being lower than that of spring 68 for the drop-in pins 47. The resulting force will press the locking pins 36 against the inner wall 44 of the fitting recess 24 or into a depression 66, 67. This ensures that the locking pins 36 will always be pushed automatically into the depressions 66, 67.

If the handle is operated in its proper mode and function, the front or push faces 19 of the handle driver 15 will drive the locking pins 36 on a circular path. Outside the depressions 66, 67, especially in the specific locking positions of the handle, the locking pins 36 will provide for continuous positive connection between the two drivers 15, 35 whereby rotation is transmitted without clearance from the square member 35 to the square bar 30. The specific locking positions of the handle correspond to specific positions of the assembled window fitting; due to freedom from play, perfect positioning of the push mechanism and thus trouble-free function of the window are warranted.

If the locking pins 36 are pressed into the locking depressions 66 or into the engaging depressions 67 during rotation, the positive connection will be released and a rotation angle clearance will be created between the two drivers 15, 35 and accordingly between the handle and the square bar 30. However, as the handle is turned further, the locking pins 36 will again be pushed out of the depressions 66, 67 by the end edges and faces, respectively, which serve as functional surfaces 69, so that the positive connection will be restored immediately. The short occurrence of a clearance of the angle of rotation between the specific locking positions of the handle will not harm the function of the window because the specific locking positions are transmitted to the window fitting without play. The tension of the compression spring is selected such that there will only be an imperceptible engagement as the locking pins 36 are pushed out of the depressions 66, 67 against the spring tension.

In the case of burglary, the coupling assembly K of the actuator will be loaded with a torque from the square bar 30. If the window handle is in a specific locking position as shown in FIG. 7*a*, the polygonal driver 35 can be turned once the engagement torque has been overcome. When the position shown in FIG. 7*b* is reached, the locking pins 36 will be pressed into an engaging depression 67 or, as shown in FIG. 7*c*, into a locking depression 66 by the tension of the compression spring 70, i.e. the depressions 67 fulfill a double function as both engaging and locking depressions The positive engagement of the locking pin 36 between the two drivers 15, 35 will be released, and the square member 30 will turn further relative to the handle driver. By displacement of the recess 31 and of its corner zones 39 acting as functional surface, the respective locking pin 36 will be pressed firmly into a locking depression 66 or 67 and cannot return inward into the recess 31 as the handle is turned further. The pin 36 now provides a positive engagement between the handle driver 15 and the depression 66 or 67 in the fitting recess 24 of the installation body 20. If the rotation angle clearance existing between the spaced contact surfaces 17, 37 of the handle driver 15 and of the square member 35, respectively, is big enough for the contact surfaces 17, 37 of the two drivers 15, 35 to meet, the handle driver 15 will also be turned for some distance. However, the positive locking between the handle driver 15 and the installation body 20 effected by the locking pin 36 prevents further turning of the two drivers 15, 35 and consequently of the square bar 30 which in the form shown may be turned through 30 degrees maximum. With such angle of rotation, the closing elements of the window fitting are still engaged, and unauthorized opening of the window will not be possible.

The variant of positive self-locking described does not necessitate high accuracy of component dimensions, but it will always ensure a reliable locking function outside the functional and engaging positions, respectively, of the handle when a torque is transmitted from the polygonal bar to the handle In and near the engaging positions of the handle, there is no rotation angle clearance between the handle and the polygonal bar so that malfunctions of the fitting are effectively prevented. High manufacturing costs of the components will reliably be avoided.

FIG. 10*a* shows the components of such a fitting in an exploded oblique view from above whereas FIG. 10*b* shows corresponding oblique views from below. It will be seen from these figures that the coupling assembly K can be embodied by a separate insert 88. For this purpose, said insert has a cylindrical fitting recess 24 whose inner circumference 44 contains the necessary locking and engaging depressions 27, 66, 67. The insert body 88 is introduced in a receptacle of matching shape in the installation body 20 and closes it at the bottom. Therefore, a bottom plate 28 will not be required. The coupling assembly may be easily and conveniently preassembled and then inserted into the mounting body 20, whereby manufacturing costs are positively influenced.

The coupling elements 36 of the coupling assembly K may be designed as roller pins, cylindrical pins, balls or other shapes. If the inner wall 44 of the installation body 20 is provided with recesses 27, it is advisable that these recesses be shaped to match the coupling elements 36; it is thus possible to use, for example, components as shown in FIGS. 6*a* to 6*c* by exchanging the locking ring 25 in FIGS. 5*a*, 5*b*. The recesses 86 will also serve as engaging depressions for receiving the balls 47.

Figures 11A, 11B, 11C:
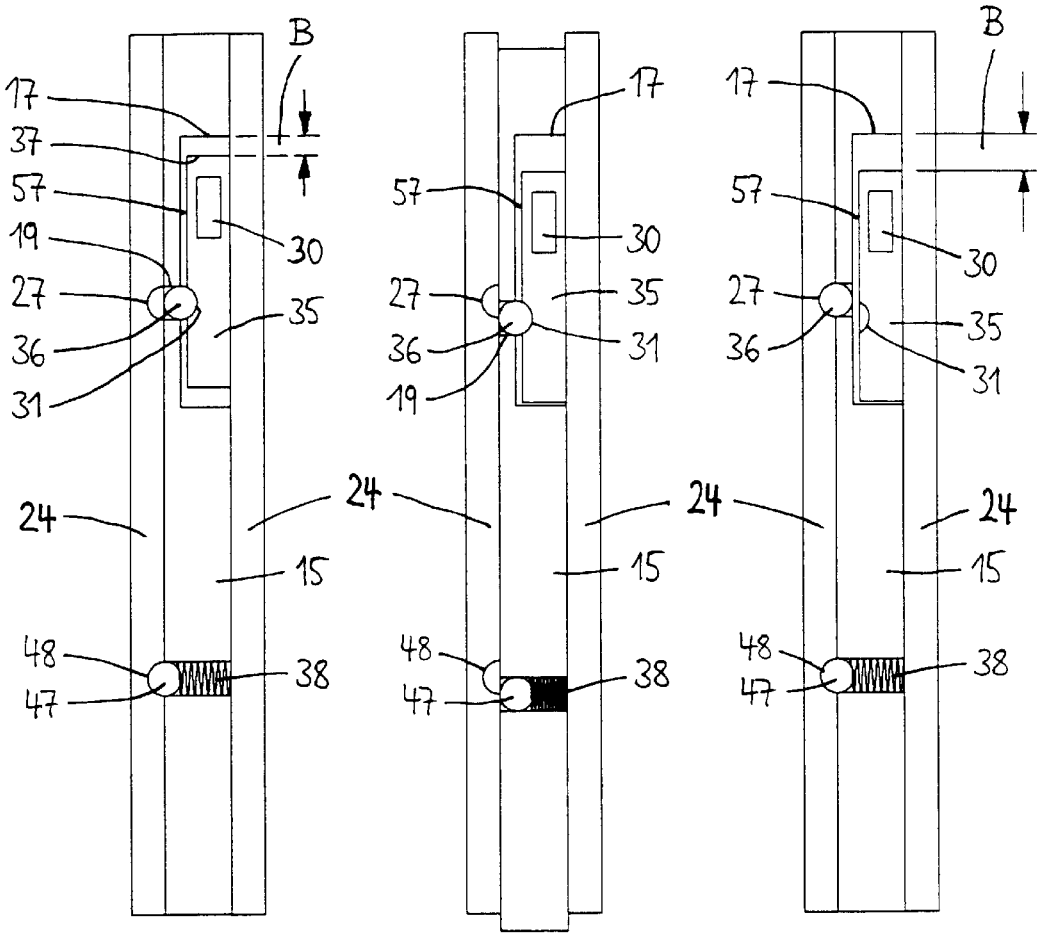

Yet another embodiment of an actuator according to the invention is shown in three different positions in FIGS. 11*a*, 11*b*, 11*c*. The handle (not shown here) is connected with a slide which also acts as handle driver 15 and is linearly guided in an enclosure 24 of the fitting, e.g. a casing or groove. A transverse hole in the handle driver 15 contains a compression spring 38 interacting with an engaging depression 48 in the casing 20 via an engaging ball 47. In the slide and the handle driver 15, respectively, there is a recess 57 in which a generally cuboid square member 35 is located that supports a square bar 30. The latter projects, for example, at a right angle to the driver 35 and perpendicular to the plane of the drawing. Said member 35 includes at either end contact surfaces 37 in opposite relation to contact surfaces 17 of the handle driver 15, with a rotation angle clearance B when the handle is in its rest position (FIG. 11*a*). The square member 35 has a depression 31 for receiving a coupling element 36 which may in particular be a drop-in pin and which is located between the push or front faces 19 of the handle driver 15.

In the rest position, the drop-in pin 36 is seated in the depression 31 of the driver 35 whereas the engaging ball 47 is in the engaging depression 48 of the casing 20. Now if the slide and the handle driver 15 are moved (FIG. 11*b*), the ball 47 will disengage and the compression spring 38 will be pressed together, whereupon the drop-in pin 36 will glide or roll along the inside of the casing. It will be seen that the slide is freely movable in the casing or mounting body 20.

If, however, force is applied to the square member 35 via the square bar 30, said member will lift the drop-in pin 36 upwards into the locking depression 27 by means of its corner zone acting as wedge surface. Consequently the slide driver 15 will be locked in a position already predetermined by the engaging ball 47, and the handle cannot be moved (FIG. 11*c*).

The invention is not restricted to the embodiments described above and may be modified in many ways. The self-locking action which counters an undesired attack from outside may be effected by frictional engagement, by positive locking or by combinations with different staggering of coupling elements on or in an enclosure 24. For this purpose, the enclosure may have friction surfaces and/or recesses or depressions which support or at least cause positive locking with coupling elements. The invention also contemplates an inverse structure with projections or elevations on or in the enclosure 24 and with corresponding recesses, e.g. locking depressions, being provided on the "inner" driver. Tiltable click-stop elements engaging into teeth provided in the inner circumference 44 of the enclosure 24 are also comprised by the invention. Instead of the roller or cylindrica pins 36, for example, detents can be located unter spring load in the outer periphery of the square member 35. The number of engaging and coupling elements, whose shapes may generally differ from those of cylinder and ball, may vary according to the design of the handle 10 and of its installation body 20. The "radial" blocking path of coupling elements 36 may likewise be predesigned according to loading condition. Important is the wedging, jamming or engaging action of coupling elements between an enclosure and a corresponding driver face.

All and any of the features and advantages of the invention, inclusive of design details, of spatial arrangements and of process steps, as evident from the claims, from the specification and from the drawings may be inventionally substantial both per se and in most variegated combinations.

List of Reference Symbols

B rotation angle clearance
D axis of rotation
K coupling assembly
L longitudinal center or axis
Q transverse axis
S starting point
10 handle
12 handle neck
13 compression spring
14 threaded hole
15 handle driver
16 recess
17 contact surface
18 [countersunk] screw
19 push or front faces
20 installation body
21 cover/cap
22 guide sleeve
23 lug
24 fitting recess/enclosure
25 locking ring
26 fastening screws
27 locking depression
28 bottom plate
29 stay bolt
30 polygonal/square bar
31 indentation/receiving depression
32 transverse hold
33 projection
34 locking pin
35 polygonal driver/square member
36 coupling element/roller pin/drop-in/detent bolt
37 contact surface
38 compression spring(s)
39 functional surface/wedge surface
40 coupling element/leaf spring
42 angle end/spring end
44 inner wall
45 projections
46 web
47 engaging ball
48 engaging depression
49 engaging bore
50 central part
51 projection

52 wing
54 annular flange
55 zone/intermediate space
56 concavity
57 recess
66 locking depression
67 engaging depression
68 compression spring (engaging)
69 functional surface/flange
70 compression spring (locking)
71 bore
84 recess
86 indentation
88 insert body
89 receptacle

What is claimed is:

1. A fitting for a window or a door for operating a closing mechanism, comprising handle means including at least one handle (10) having a handle neck (12), the handle neck being axially tight but pivotally supported on or in an installation body (20), which body is adapted to be fastened to a flat support, in particular to a room closing element, and further comprising a polygonal bar (30) engaging into or penetrating the installation body (20), the bar (20) being connected for rotation with the handle (10) for actuating the closing mechanism, wherein a coupling assembly (K) is provided between the handle (10) and the polygonal bar (30) such that a torque transmission is achievable from the handle (10) and the polygonal bar (30) but is blocked from the polygonal bar (30) to the handle (10), the coupling assembly (K) having two drivers (15,35) arranged between the handle (10) and the polygonal bar (30), which drivers are adapted to be coupled together in a positive or non-positive manner and either directly or via at least one coupling member (36,40, 42) under a predefined clearance of motion (B) between neighboring driver surfaces (17,37) in such a way that a torque acting on the handle (10) will be transmitted to the polygonal bar (30), but that a torque acting on the polygonal bar (30) will stop its movement and will block an actuation of the closing mechanism.

2. Fitting according to claim 1, wherein a first driver (15) is connected for rotation with the handle (10) and a second driver (35) is connected for rotation with the polygonal bar (30), both drivers (15, 35) being movable relative to each other within an enclosure (24) that is associated to the fitting.

3. Fitting according to claim 2, wherein the enclosure (24) is formed in the bottom of the installation body (20).

4. Fitting according to claim 2, wherein the enclosure (24) is formed in an insert (25,88) adapted to fit in the installation body (20).

5. Fitting according to claim 2, wherein the enclosure (24;44) consists of a material that is more resilient than one or both of a material of a one of the drivers and a material of the coupling element (36).

6. Fitting according to claim 1, wherein one of a frictional engagement, a positive connection and a non-positive connection is achievable using one or more of the at least one coupling element (36,40,42), the handle driver (15), the polygonal driver (35) and an enclosure (24) for stopping movement of the polygonal bar (30).

7. Fitting according to claim 1, wherein each coupling element (35, 40, 42) is adapted to be displaced or actuated by means of functional surfaces or flanges (17, 37; 19, 27, 31, 39; 66, 67, 69) formed on the drivers (15, 35) as well as on an enclosure (24).

8. Fitting according to claim 7, wherein diametrically opposed central parts (50) of a handle driver (15) guide a compression spring (38), which loads engaging balls (47) outwardly, one or both of the coupling elements (36) and engaging balls (47) being radially movable by attack of indentations (31) and of recesses (27, 66, 67), in particular by functional surfaces (69) formed in corner zones toward the inner periphery (44) of the fitting recess (24).

9. Fitting according to claim 1, wherein one or both of the handle driver (15) and the polygonal driver (35) is lockable in at least one specific functional position of the closing mechanism by detent or engaging means (47,67).

10. Fitting according to claim 1, wherein an enclosure (24) of the fitting comprises a cylindrical fitting recess in which the drivers (15, 35) are pivotable, with a handle driver (15) concentrically enclosing at least a main portion of a polygonal driver (35).

11. Fitting according to claim 1, wherein a projection (33) of one of the drivers (35) extends to an inner wall (44) of a cylindrical fitting recess (24) and wherein a leaf spring (40) is provided as coupling element, which spring encloses with its main portion the handle driver (15) and bears against an enclosure (24;44) and which fits, with inwardly bent ends (42), that match a shape of the projection (33) between contact surfaces (17,37) of the drivers (15,35).

12. Fitting according to claim 1, wherein the drivers (15, 35) have engaging elements designed as projections (51) and matching concavities (56) and are correlated with a clearance (B) of the angle of rotation so that opposite contact surfaces (17, 37) of the drivers (15, 35) will be kept apart in a rest position.

13. Fitting according to claim 12, wherein the handle driver (15) has curved wings (52) at a central part (50) whose peripheral ends comprise push or front faces (19).

14. Fitting according to claim 1, wherein the coupling elements (36) are roller pins, drop-in pins, cylindrical pins, cylindrical rolls or balls.

15. Fitting according to claim 1, wherein the coupling elements (36) form at least one pair of coupling members, each pair being loaded by a compression spring (38) so as to bear against adjacent front faces (19) of a handle driver (15) and being arranged in an intermediate space (55) of approximately trapezoidal basic shape which is confined by a cylindrical inner wall (44) of a cylindrical fitting recess (24), by push or front faces (19) of the handle driver (15) as well as by wedge surfaces (39) of a polygonal driver (35) and which space (55) widens towards an associated spring (38), and wherein the coupling elements (36) are movable radially outward by attack of the wedge surfaces (39) of the polygonal driver (35).

16. Fitting according to claim 1, wherein one coupling element (36) each is arranged between faces (19) of a handle driver (15) and wherein an indentation (31) in the polygonal driver (35) is assigned in a radial inward direction to each coupling element (36), at least corner zones of said indentation being adapted to act on the coupling element (36).

17. Fitting according to claim 1, wherein at least four recesses or locking depressions (27, 66) corresponding to the coupling elements (36) are provided in the inner wall (44) of a fitting recess (24).

18. Fitting according to claim 1, wherein each coupling element (36) is spring-loaded in a radial outward direction.

19. Fitting according to claim 1, wherein diametrically opposed central parts (50) of a handle driver (15) guide a compression spring (38) which loads engaging balls (47) outwardly.

20. Fitting according to claim 19, wherein at least four engaging depressions (67) corresponding to the engaging balls (47) are provided in an inner wall (44) of a fitting recess (24).

21. Fitting according to claim 19, wherein the engaging balls (47) are bigger than the coupling elements (36), having in particular a greater length and diameter.

22. Fitting according to claim 19, wherein each coupling element is spring-loaded in a radial direction, and spring tension acting on the engaging balls 47 is greater than spring tension acting on the coupling elements (36).

23. Room closing element comprising a fitting according to claim 1.

* * * * *